US007653954B2

(12) United States Patent
Hornbach et al.

(10) Patent No.: US 7,653,954 B2
(45) Date of Patent: Feb. 2, 2010

(54) LIFT SYSTEM FOR A PATIENT-SUPPORT APPARATUS

(75) Inventors: David W. Hornbach, Brookville, IN (US); Darrell L. Metz, Batesville, IN (US); Terry J. Stratman, Villa Hills, KY (US)

(73) Assignee: Hill-Rom Services, Inc., Wilmington, DE (US)

( * ) Notice: Subject to any disclaimer, the term of this patent is extended or adjusted under 35 U.S.C. 154(b) by 18 days.

(21) Appl. No.: 11/960,254

(22) Filed: Dec. 19, 2007

(65) Prior Publication Data

US 2008/0148486 A1 Jun. 26, 2008

Related U.S. Application Data

(60) Provisional application No. 60/871,017, filed on Dec. 20, 2006, provisional application No. 60/884,793, filed on Jan. 12, 2007, provisional application No. 60/956,805, filed on Aug. 20, 2007.

(51) Int. Cl.
*A47B 7/00* (2006.01)
*A47C 31/00* (2006.01)

(52) U.S. Cl. ..... 5/611; 5/11

(58) Field of Classification Search ..... 5/611, 5/11, 509.1; 254/4 C, 47; 187/210, 213, 187/259, 261
See application file for complete search history.

(56) References Cited

U.S. PATENT DOCUMENTS

| | | | | |
|---|---|---|---|---|
| 0,392,009 | A | | 10/1888 | Cleaveland |
| 0,541,339 | A | | 6/1895 | Thompson |
| 1,206,536 | A | | 11/1916 | Hill |
| 1,218,519 | A | | 3/1917 | Bradley |
| 1,347,271 | A | | 7/1920 | Hartman |
| 1,902,249 | A | | 3/1933 | Lanzy |
| 2,026,153 | A | | 12/1935 | Wright et al. |
| 2,262,643 | A | * | 11/1941 | McNabb ..... 5/11 |
| 2,523,076 | A | * | 9/1950 | Sweetland ..... 5/611 |
| 2,590,337 | A | * | 3/1952 | McNabb et al. ..... 5/11 |
| 2,658,207 | A | * | 11/1953 | Robbins ..... 5/11 |
| 2,681,454 | A | | 6/1954 | Tallman |
| 2,913,300 | A | | 11/1959 | Darnell et al. |
| 2,968,050 | A | | 1/1961 | Shankman |
| 3,012,253 | A | | 12/1961 | Reichert |
| 3,032,154 | A | * | 5/1962 | McNabb, Jr. ..... 5/11 |

(Continued)

FOREIGN PATENT DOCUMENTS

| | | |
|---|---|---|
| DE | 2023104 | 11/1971 |

(Continued)

OTHER PUBLICATIONS

International Search Report dated Jun. 4, 2008, for PCT/US2007/088125.

*Primary Examiner*—Peter M Cuomo
*Assistant Examiner*—Brittany M Wilson
(74) *Attorney, Agent, or Firm*—Barnes & Thornburg LLP

(57) ABSTRACT

A patient-support apparatus includes a patient-support deck coupled to first and second lift systems configured to lift the patient-support deck relative to the floor. The lift systems each include a pair of supports and a carriage coupled to the patient-support deck and suspended from the supports by tethers which are wound and unwound to raise and lower the patient-support deck.

23 Claims, 11 Drawing Sheets

U.S. PATENT DOCUMENTS

| | | | | |
|---|---|---|---|---|
| 3,061,843 | A | | 11/1962 | Singer et al. |
| 3,237,212 | A | | 3/1966 | Hillenbrand et al. |
| 3,271,795 | A | | 9/1966 | Hillenbrand et al. |
| 3,281,872 | A | | 11/1966 | Dewey |
| 3,309,717 | A | | 3/1967 | Black |
| 3,436,769 | A | | 4/1969 | Burst |
| 3,564,627 | A | | 2/1971 | Allard et al. |
| 3,633,225 | A | | 1/1972 | Burst et al. |
| 3,636,573 | A | | 1/1972 | Bartz |
| RE27,966 | E | | 4/1974 | Burst |
| 3,821,821 | A | | 7/1974 | Burst et al. |
| 3,974,530 | A | | 8/1976 | Lusch et al. |
| 4,005,497 | A | | 2/1977 | Sutter |
| 4,043,219 | A | | 8/1977 | Schatti |
| 4,346,487 | A | | 8/1982 | Holdt et al. |
| 4,435,861 | A | | 3/1984 | Lindley |
| 4,494,259 | A | | 1/1985 | Miller et al. |
| 4,724,555 | A | | 2/1988 | Poehner et al. |
| 5,020,169 | A | | 6/1991 | Hamada et al. |
| 5,185,894 | A | | 2/1993 | Bastert et al. |
| 5,279,010 | A | | 1/1994 | Ferrand et al. |
| 5,544,375 | A | | 8/1996 | Urness et al. |
| 5,553,335 | A | * | 9/1996 | Lahtinen ..... 5/81.1 C |
| 5,685,035 | A | | 11/1997 | Urness et al. |
| 5,706,536 | A | | 1/1998 | Krauska |
| 5,724,685 | A | | 3/1998 | Weismiller et al. |
| 5,802,639 | A | * | 9/1998 | Raasch et al. ..... 5/611 |
| 5,940,911 | A | | 8/1999 | Wang |
| 6,058,798 | A | | 5/2000 | Lantzsch |
| 6,101,647 | A | | 8/2000 | Stroud et al. |
| 6,305,499 | B1 | * | 10/2001 | Jones et al. ..... 187/261 |
| 6,505,365 | B1 | * | 1/2003 | Hanson et al. ..... 5/611 |
| 6,591,845 | B1 | * | 7/2003 | Bergman et al. ..... 134/100.1 |
| 2004/0221386 | A1 | * | 11/2004 | Loewenthal ..... 5/11 |
| 2005/0223491 | A1 | * | 10/2005 | McCrimmon ..... 5/11 |
| 2006/0260054 | A1 | | 11/2006 | Lubbers et al. |

FOREIGN PATENT DOCUMENTS

| | | |
|---|---|---|
| DE | 3516081 | 11/1986 |
| EP | 0316905 | 5/1989 |
| EP | 0403073 | 12/1990 |
| EP | 0558838 | 9/1993 |
| FR | 2725600 | 4/1996 |
| WO | 9820829 | 5/1998 |

* cited by examiner

LIFT SYSTEM FOR A PATIENT-SUPPORT APPARATUS

This application claims priority under 35 U.S.C. § 119(e) to U.S. Provisional Patent Application Nos. 60/871,017, filed Dec. 20, 2006, 60/884,793, filed Jan. 12, 2007, and 60/956,805, filed Aug. 20, 2007, each of which is hereby incorporated by reference herein.

BACKGROUND OF THE INVENTION

The present disclosure is related to patient-support apparatuses having lift systems.

Patient-support apparatuses such as a hospital beds, for example, are known to use linear actuators which extend and retract to move portions of the apparatus relative to other portions. Movement of one portion of the patient support apparatus relative to another portion results in raising patient-support deck sections of the apparatus relative to some support frame, or lifting an entire patient-support deck relative to other members of the patient-support apparatus. Lift motors are known to be positioned beneath the patient-support deck and occupy a space between the patient-support deck and the floor.

SUMMARY OF THE INVENTION

The present disclosure comprises one or more of the features recited in the appended claims and/or the following features which, alone or in any combination, may comprise patentable subject matter:

According to the present disclosure, a patient-support apparatus includes a plurality of supports, a tether coupled to a support, a patient-support platform, and winding means for winding and unwinding the tether to vary the height of the patient-support platform. The winding means may be secured to the patient-support platform. The patient-support platform may include a frame and a plurality of deck sections pivotable relative frame. The patient-support platform may further include a plurality of actuators with each actuator coupled to a deck section and operable to move the deck section relative to the frame.

The winding means may include a spool and a prime mover coupled to the spool and configured to rotate the spool to wind and unwind the tether. The prime mover may include an electric motor. The prime mover may further include a limit assembly driven by the output of the motor, the limit assembly configured to limit operation of the motor when the patient-support platform reaches a vertical limit. The prime mover may further include a speed reducer interposed between the motor and the spool The tether may include a stainless steel band.

Also according to the present disclosure, a lift system for a patient-support apparatus may include a tether configured to be coupled to a first portion of the patient-support apparatus, and a winder coupled to the tether distal to the first portion. The winder may be configured to be coupled to a second portion of the patient-support apparatus and to rotate relative to the second portion of the patient-support apparatus. The winder may be further configured to wind the tether to vertically raise the second portion relative to the first portion and to unwind the tether to vertically lower the second portion relative to the first portion.

The winder may include a spool and a motor to drive the spool. The motor may also drive a limit assembly configured to limit the operation of the motor when the patient-support platform reaches a vertical limit. The winder may include a speed reducer interposed between the motor and the spool. The tether of the lift system may include a stainless steel strap.

Still also according to the present disclosure, a patient-support apparatus includes a patient-support platform, a plurality of columns configured to engage a floor, a tether coupled to a column, and a winder coupled to the patient-support platform. The winder is suspended by the tether and configured to gather the tether and release a tether to thereby raise and lower the patient-support platform relative to the floor.

The winder may be driven by a motor. The patient-support platform may include a frame and a plurality of deck sections pivotable relative to the frame. The winder may include a spool, a motor to drive the spool. The output of the motor may also drive a limit assembly configured to limit the operation of the motor when the patient-support platform reaches a vertical limit.

The tether may include a first tether portion coupled to a first column and a second tether portion coupled to a second column. When two tether portions are present, the tether portions are contemporaneously gathered and released by the winder such that the patient-support platform raises and lowers along each of the first and second columns at generally the same speed. The patient-support platform may include an outer tube coupled to the frame and configured to receive a column and a spool coupled to the outer tube. The spool may be configured to engage the tether and to rotate relative to the outer tube as the tether is gathered and released by the winder such that the spool guides the tether to the winder as the winder rotates.

Yet still according to the present disclosure, a patient-support apparatus may include a first portion, a tether coupled to a first portion of the patient-support apparatus, a second portion of the patient-support apparatus movable relative to the first portion, and a winder coupled to the tether distal to the first portion. The winder may be supported on the second portion and rotatable relative to the second portion to wind and unwind the tether to thereby raise and lower the second portion of the patient-support apparatus relative to the first portion. The winder may be driven by a motor. The tether may engage a roller on the second portion. The roller may be configured to guide the tether as the winder gathers and releases the tether. The tether may include a stainless steel strap. The winder may include a spool, a motor driving the spool to rotate the spool about a horizontal axis, and a speed reducer interposed between the motor and the spool.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
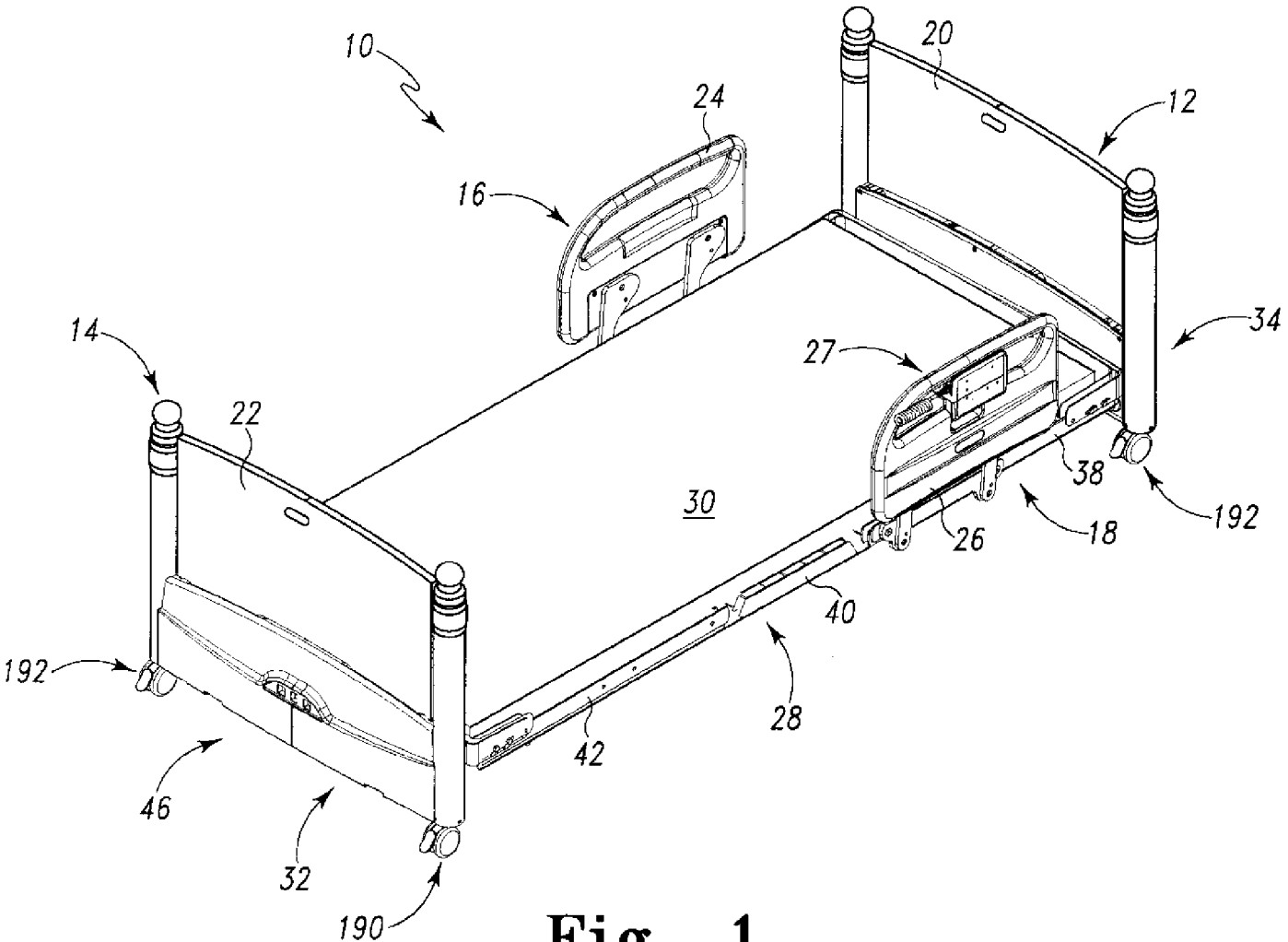
FIG. 1 is a perspective view of a patient-support apparatus including a pair of lift systems position near the head end and near the foot end of the patient-support apparatus.
Figure 2:
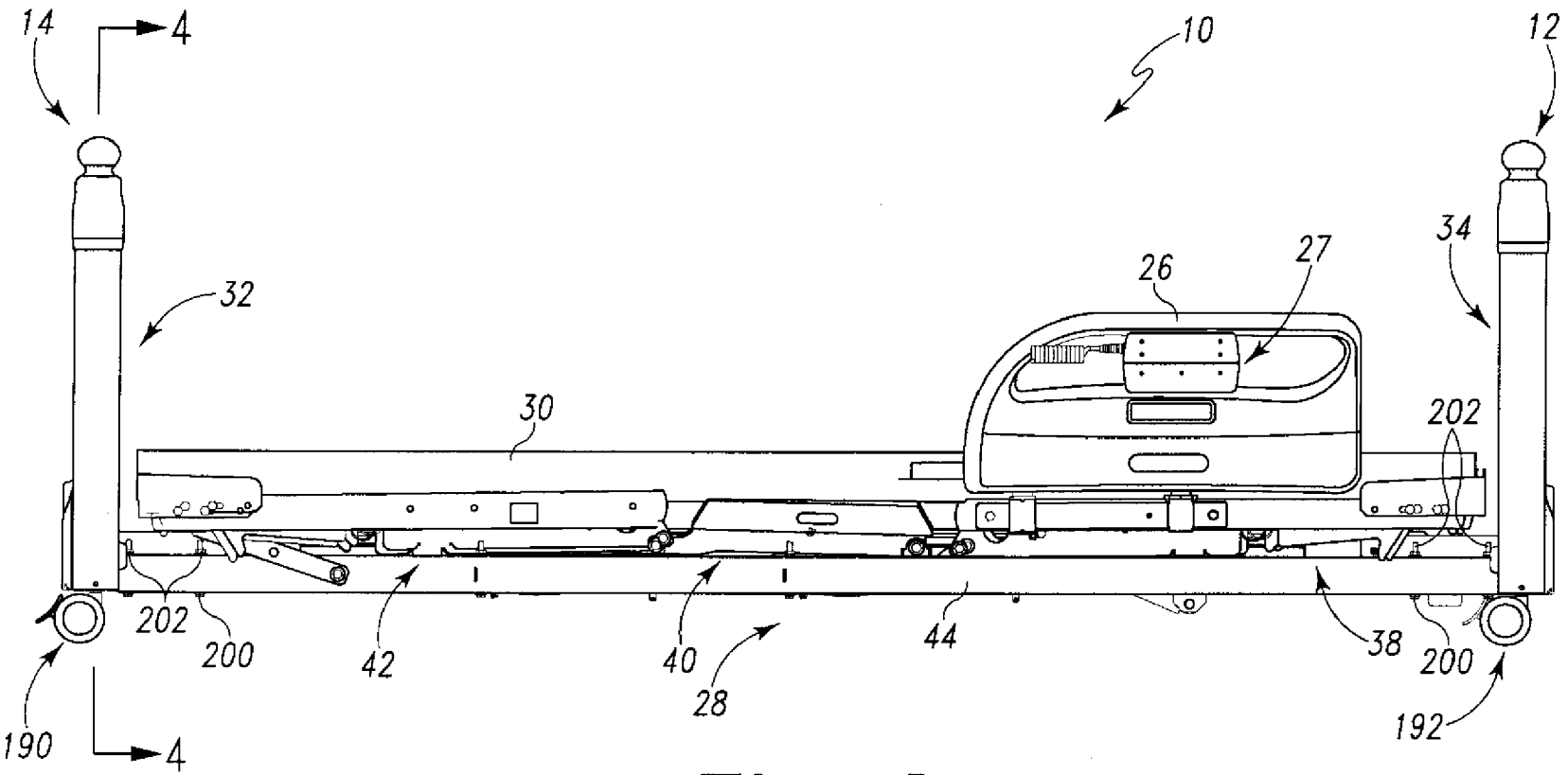
FIG. 2 is a side view of the patient-support apparatus of FIG. 1, the patient-support apparatus with the patient-support deck positioned at a lowest vertical position.

According to the present disclosure, a patient-support apparatus 10 embodied as a bed includes a patient-support platform 28 supported on two lift systems 32, 34 and movable vertically to change the elevation of the patient-support platform 28. Illustratively, bed 10 may be used either in a home or in an institution such as a hospital or nursing facility, for example. Bed 10 includes a panel 20 positioned near a head end 12 of the bed and a similar panel 22 positioned near the foot end 14 of the bed. In addition, a side rail 24 is positioned at the patient right 16 of the bed 10 and a second side rail 26 is positioned at the patient left 18 side of the bed 10. Illustratively, a pendant 27 is coupled to siderail 26. Pendant 27 is a user input device for an occupant of bed 10 or a caregiver to activate the various drives and functions of bed 10. It should be understood that the reference to "head and" and "foot end" of the bed 10 are provided for clarity in understanding the various figures and do not refer to any particular point or structure unless otherwise noted. Generally, a person occupies a bed such as bed 10 in a supine position and reference to patient right 16 and patient left 18 provide a basis for understanding the various figures.

Figure 5:
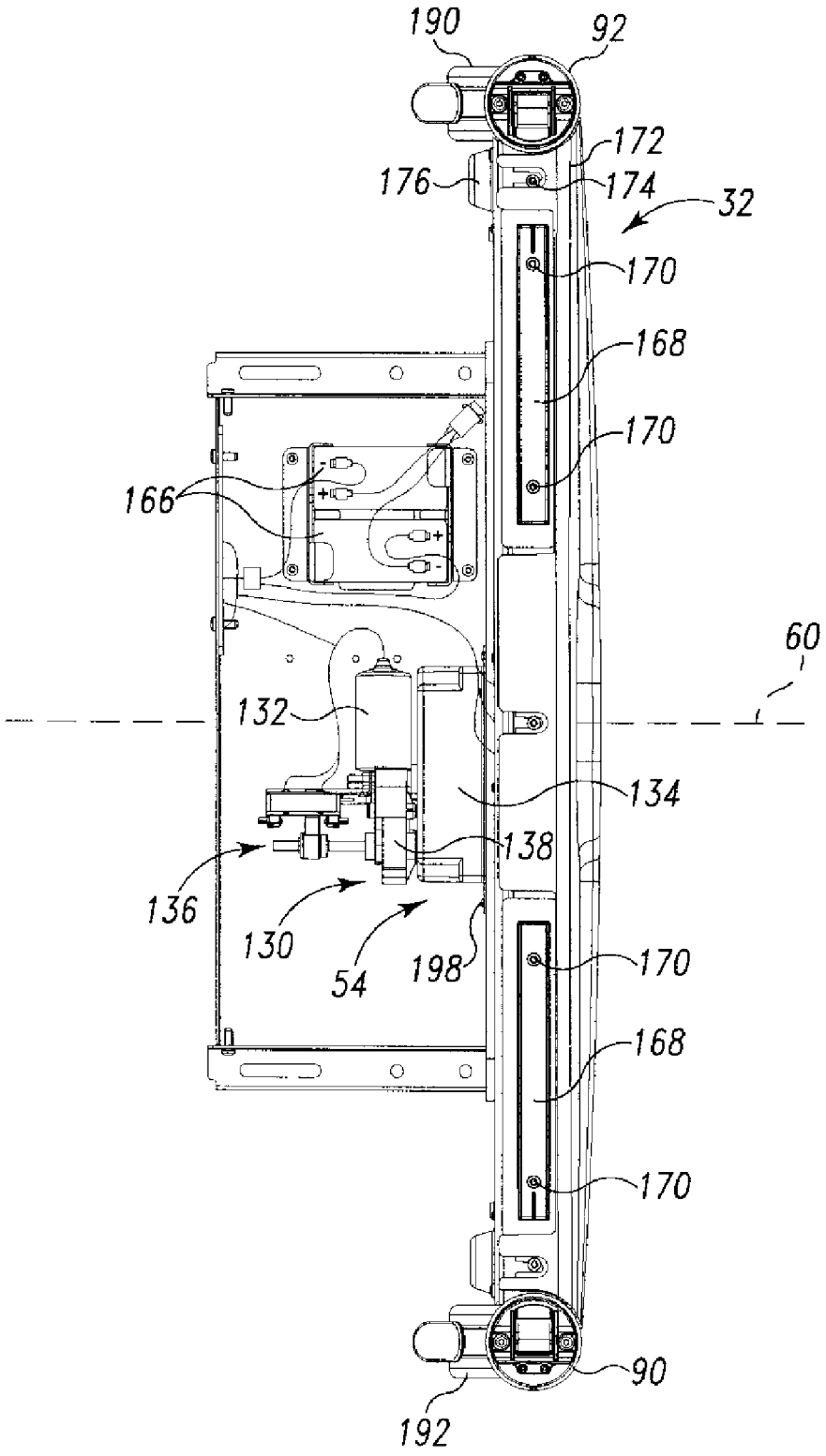
FIG. 5 is a top view of the lift system positioned near the foot end of the patient-support apparatus shown in FIG. 1, the lift system having portions removed.

Patient-support platform 28 includes a head deck section 38, a seat deck section 40, and a foot deck section 42 which are each supported on a frame 44 (seen best in FIG. 5). Deck sections 38, 40 and 42 are each pivotable relative to frame 44 to vary the position of a patient-supported thereon. In the illustrative embodiment, bed 10 further includes a mattress 30 which is supported on the deck sections 38, 40 and 42 and on which a patient is supported.

Foot end lift system 32 and head end lift system 34 each support frame 44 and are operable to raise and lower the respective ends of the patient-support platform 28. Foot end lift system 32 includes a user input panel 46 which may be used by a caregiver to deactivate the various drives of the bed 10 to lockout movement of the seat deck section 40, head deck section 38, and/or the lift systems 32, 34. Head end lift system 34 is substantially similar to the foot end lift system 32, however it should be noted that head end lift system 34 has the user input panel 46 omitted. The following discussion will describe the structure of the foot end lift system 32 and it should be understood that head end lift system 34 is a similar structure. While in the illustrative embodiment only lift system 32 includes user input panel 46, it should be understood that the system 34 could also include a user input panel 46 in some embodiments. Similarly, it should be understood that user input panel 46 may be omitted from both of the lift systems 32 and 34 in some embodiments and the user input devices could be positioned elsewhere on patient-support apparatus 10.

Figure 3:
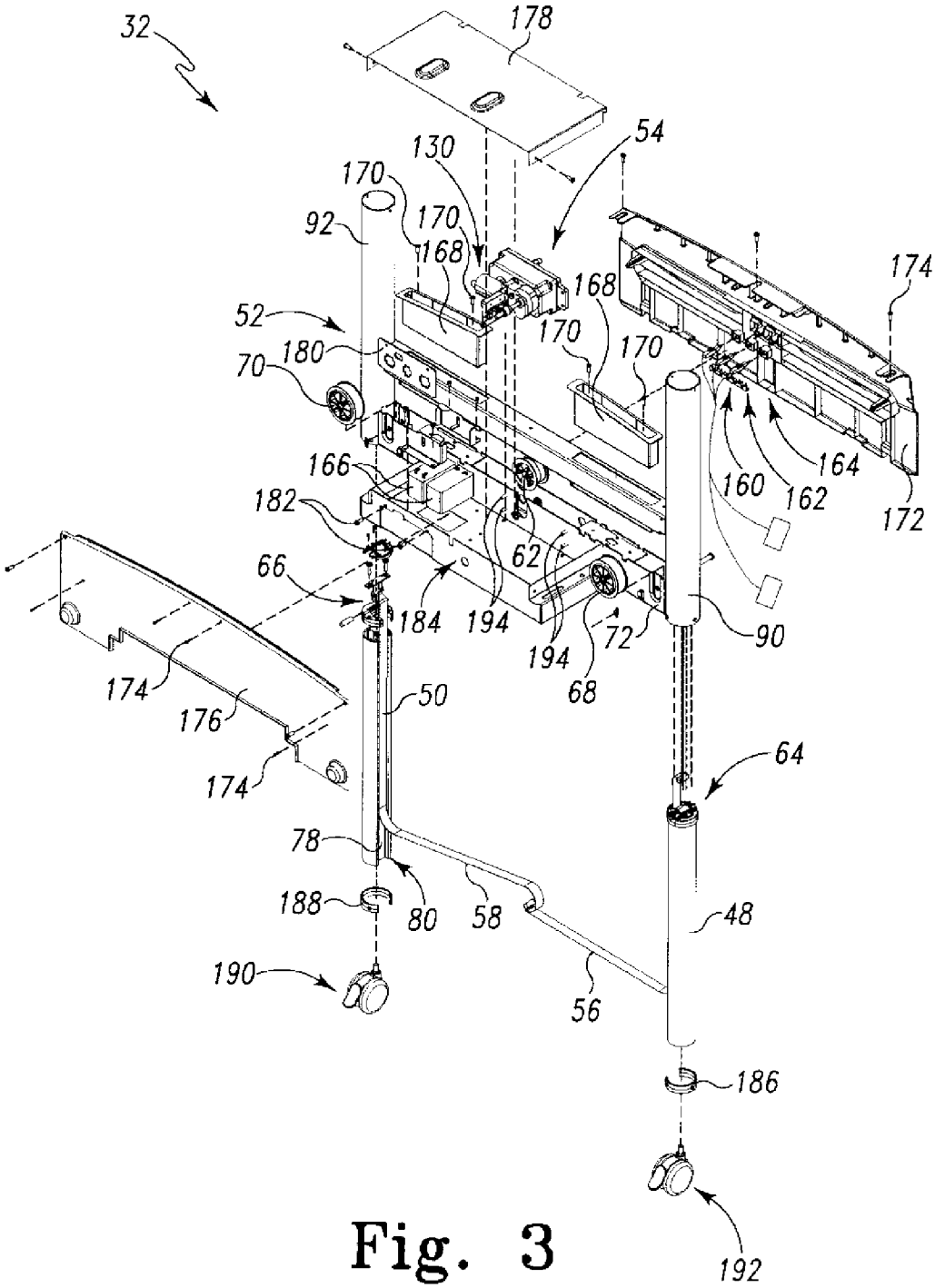
FIG. 3 is an exploded perspective assembly view of the lift system positioned near the foot and of the patient-support apparatus of FIG. 1, from the perspective of a person positioned at the patient's right side of the bed looking toward the foot end lift system.

Referring now to FIG. 3, lift system 32 includes a pair of supports 48, 50, a carriage 52 which is movable vertically relative to supports 48 and 50, a winder 54 supported on carriage 52, and a pair of tethers 56, 58 which engage with the winder 54 and are coupled to the respective supports 48 and 50 such that the carriage 52 is suspended from the tethers 56 and 58. As will be described in more detail below, as the winder rotates about an axis 60 tethers 56 and 58 are wrapped about a spool 62 which reduces the distance between the spool 62 in the top ends 64 and 66 of the supports 48 and 50 respectively. Winding of the tethers 56 and 58 about spool 62 causes the carriage 52 to travel vertically upwardly along the supports 48 and 50.

Figure 4:
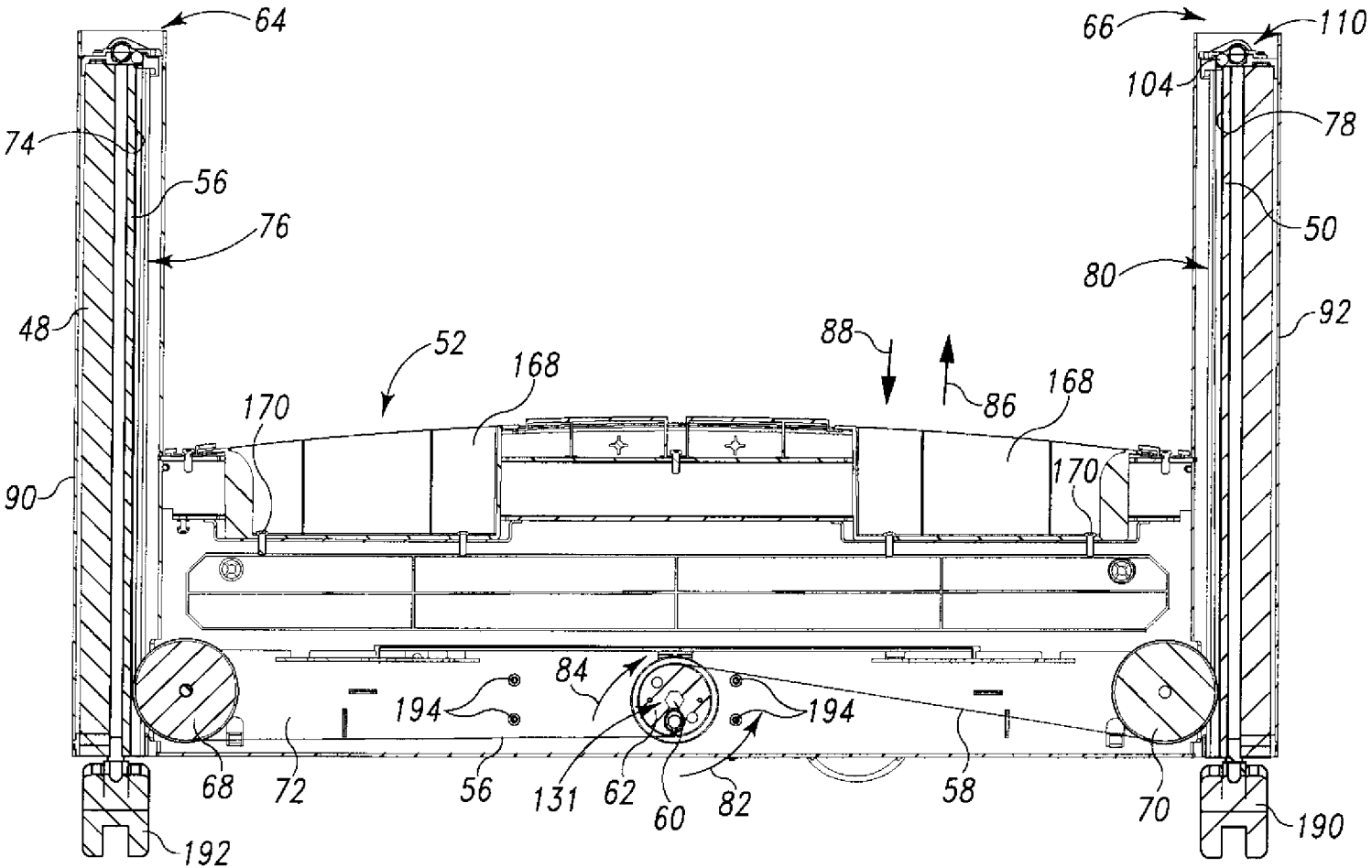
FIG. 4 is a cross-sectional view of the lift system positioned near the foot end of the patient-support apparatus of FIG. 1, the cross-section taken along the lines 4-4 in FIG. 2 and looking toward the head end of the patient-support apparatus.

Tether 56 is guided by a spool 68 which is rotatably mounted to a frame 72 of the carriage 52. Spool 68 is positioned to maintain tether 56 in a vertical alignment along support 48 as a carriage 52 moves vertically along the supports 48 and 50. Spool 68 engages with a channel 76 formed in support 48 and maintains engagement with the channel as carriage 52 moves vertically. As seen in FIG. 4, the positioning of spool 68 is such that tether 56 tangentially contacts of the outer surface of spool 68 and is aligned with a surface 74 of channel 76. The spool 68 and the channel 76 cooperate to maintain tether 56 in proper vertical alignment along support 48 as carriage 52 moves vertically. A second spool 70 guides tether 58 as carriage 52 moves along support 50. Spool 70 is rotatably coupled to frame 72 of carriage 52 and is positioned such that tether 58 is maintained in proper vertical alignment. Support 50 also includes a channel 80 having a surface 78 similar to surface 74 of channel 76. When spool 62 rotates in the direction of the arrow 82, tethers 56 and 58 are wound upon spool 62 with the various layers of tethers 56 and 58 winding upon one another. As the tethers are wrapped, carriage 52 moves vertically in the direction of arrow 86. As spool 62 is rotated in the direction of arrow 84 tethers 56 and 58 are unwound from spool 62 resulting in movement of carriage 52 in the direction of arrow 88.

The carriage 52 further includes a pair of cover tubes 90 and 92 coupled to frame 72 of carriage 52. Cover tubes 90 and 92 are sized to receive supports 48 and 50 respectively and to move vertically relative to supports 48 and 50 as the winder 54 winds tethers 56 and 58. Spools 68 and 70 are positioned on frame 72 such that tethers 56 and 58 are enclosed within frame 72 or cover tubes 90 and 92 as carriage 52 moves vertically.

Figure 6:
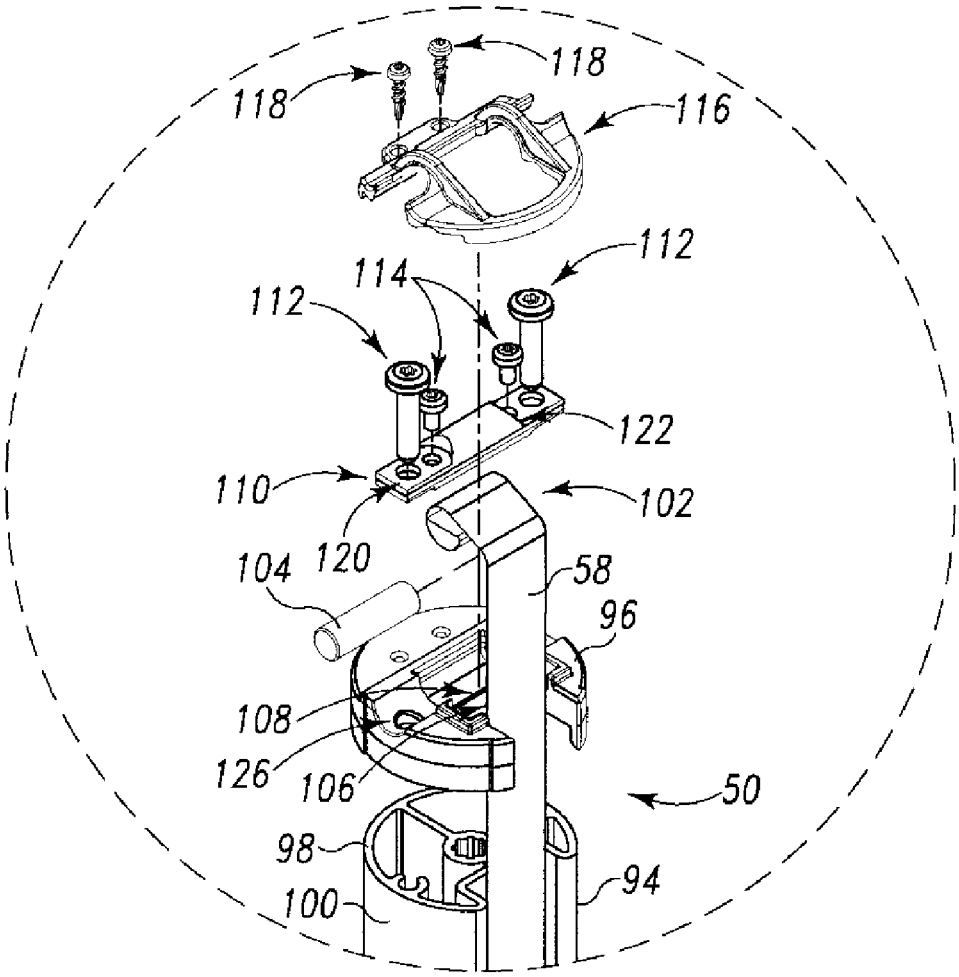
FIG. 6 is an enlarged exploded perspective view of a portion of the lift system shown in FIG. 3.

Tethers 56 and 58 are coupled to supports 48 and 50 in a manner in which the force of the load of patient-support platform 28 and carriage 52 utilizes the load to assist in securing the tether to the support. Referring now to FIG. 6, the assembly of tether 58 to support 50 is illustrated. Support 50 includes a column 94 which is illustratively embodied as an aluminum extrusion, and a cap member 96 configured to be received on the column 94. The topper 96 is formed to include a flange about a periphery of the topper 96 and a sized such that the flange extends beyond a top surface 98 of column-member 94 such that the flange of topper 96 engages a sidewall 100 of column-member 94.

Figure 7:
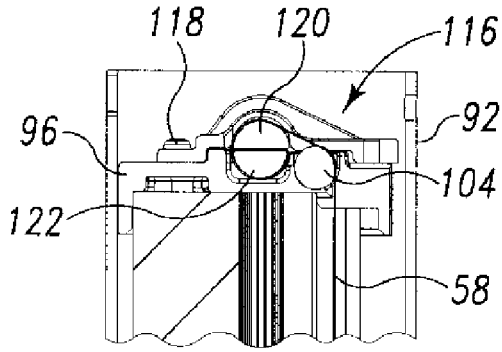
FIG. 7 is a cross-sectional view of the structure shown in FIG. 6, in an assembled condition
Figure 8A:
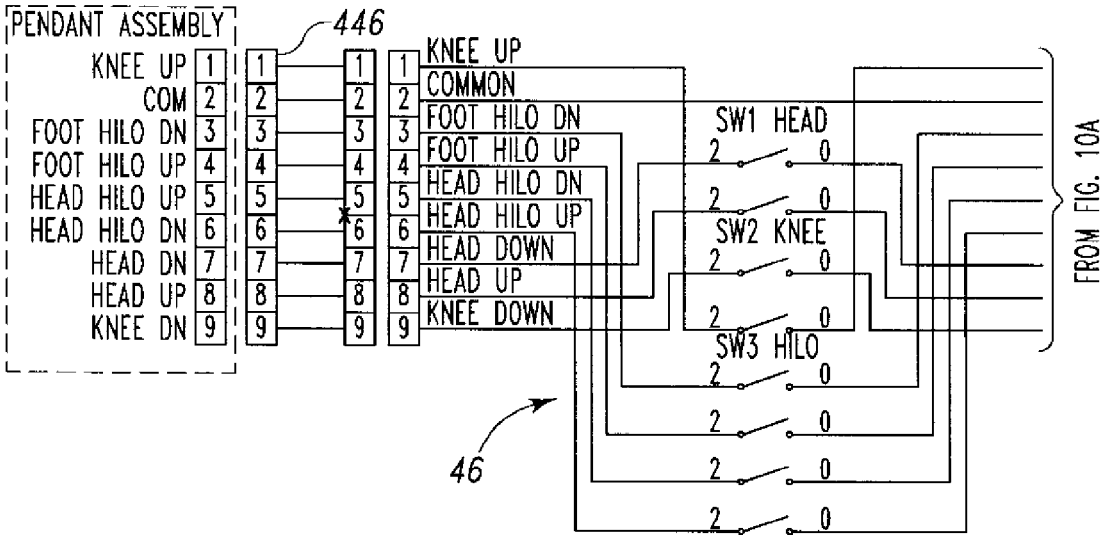
FIG. 8A is portion of a schematic diagram of the electrical system of the patient-support apparatus of FIG. 1.
Figure 8B:
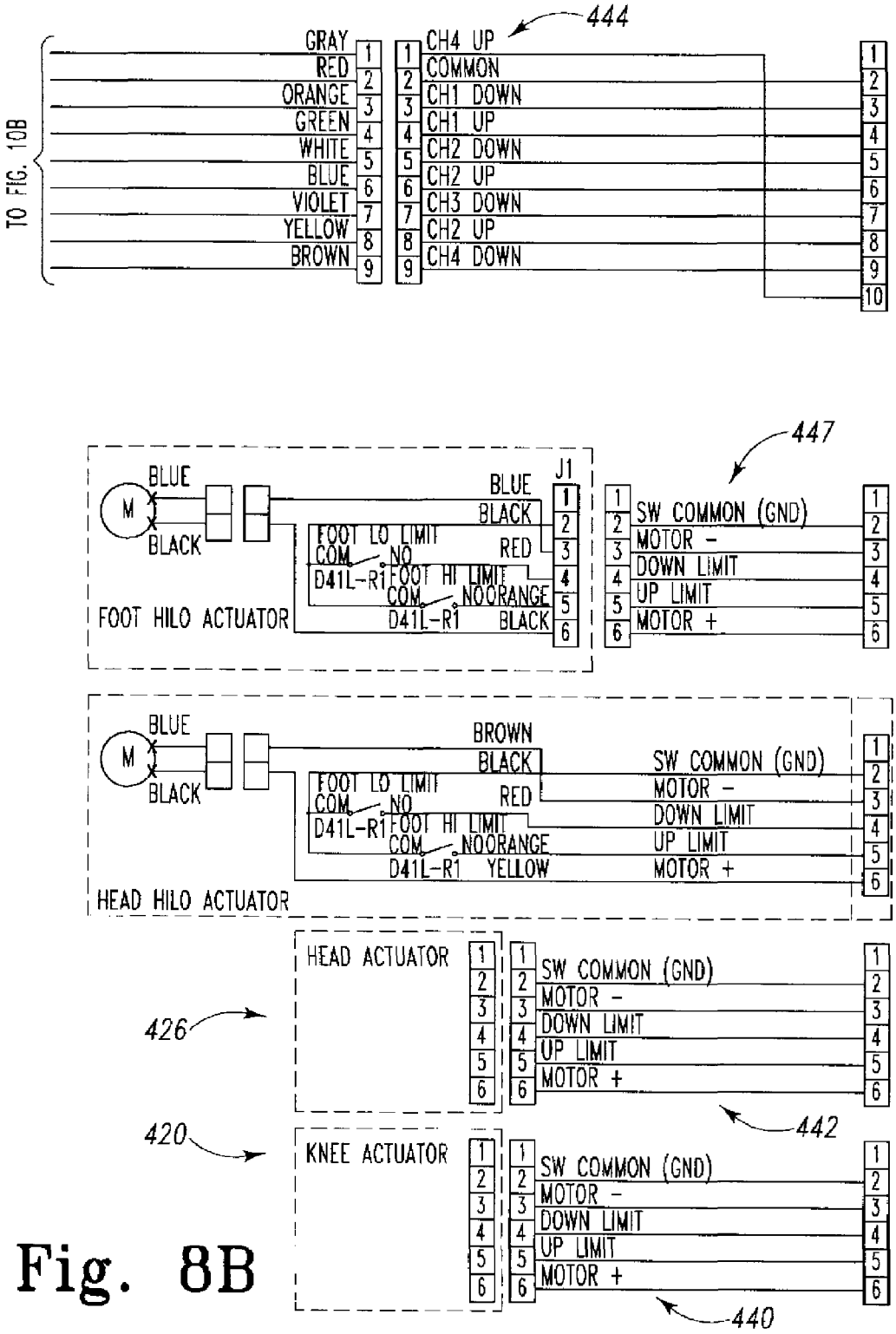
FIG. 8B is portion of a schematic diagram of the electrical system of the patient-support apparatus of FIG. 1.
Figure 8C:
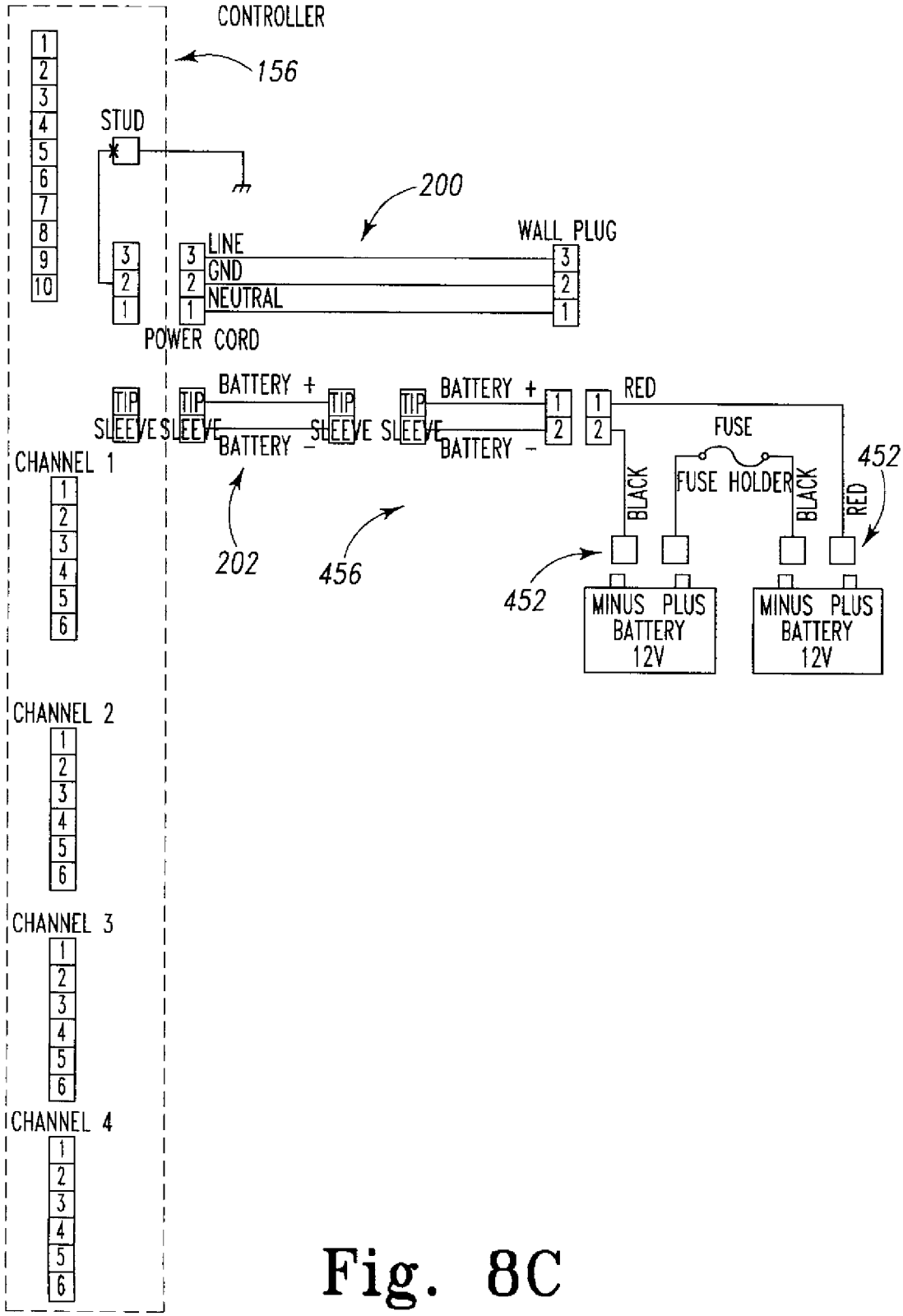
FIG. 8C is portion of a schematic diagram of the electrical system of the patient-support apparatus of FIG. 1.
Figure 9:
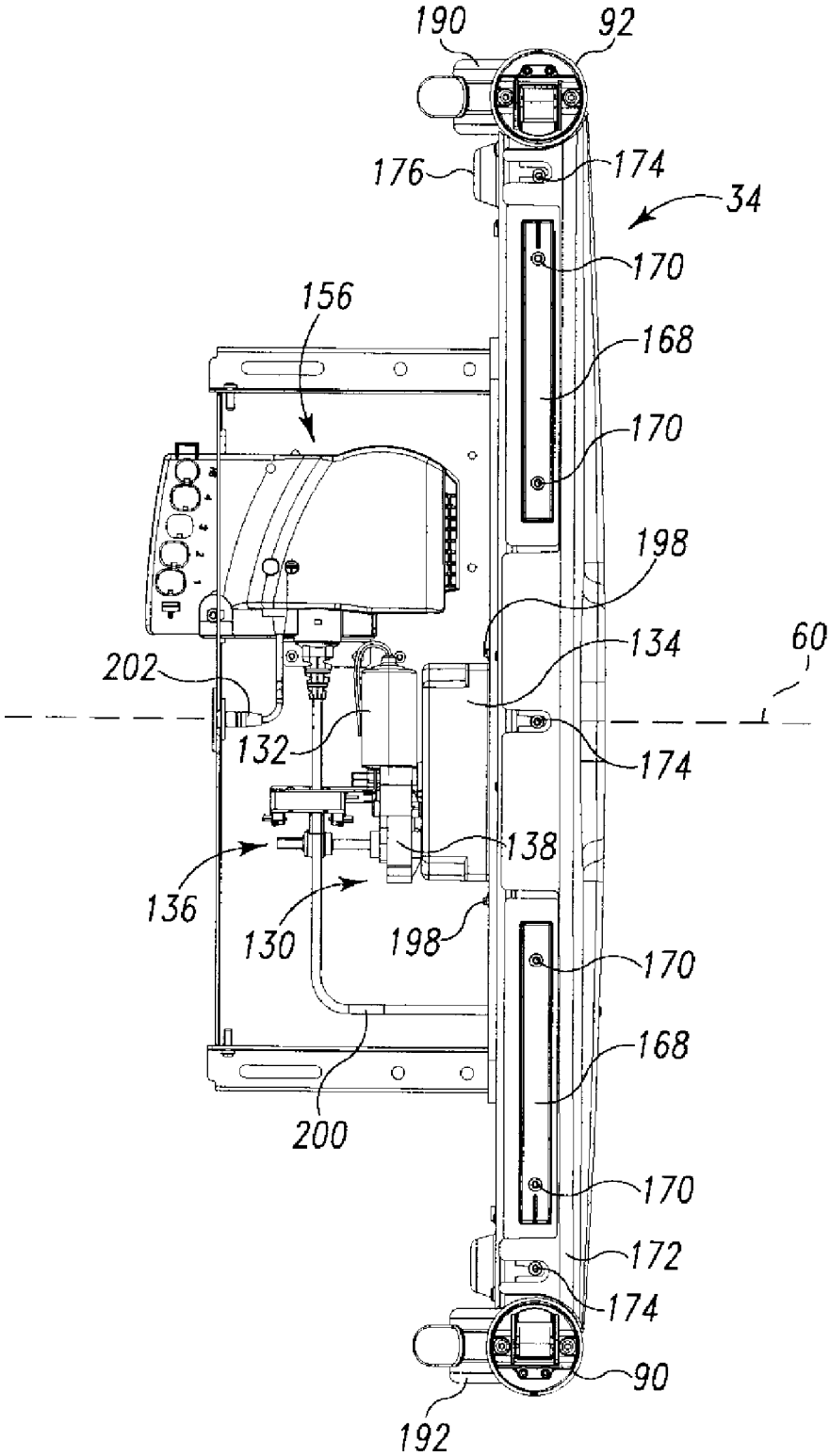
FIG. 9 is a top view of the lift system positioned near the head end of the patient-support apparatus shown in FIG. 1, the lift system having portions removed.
Figure 10:
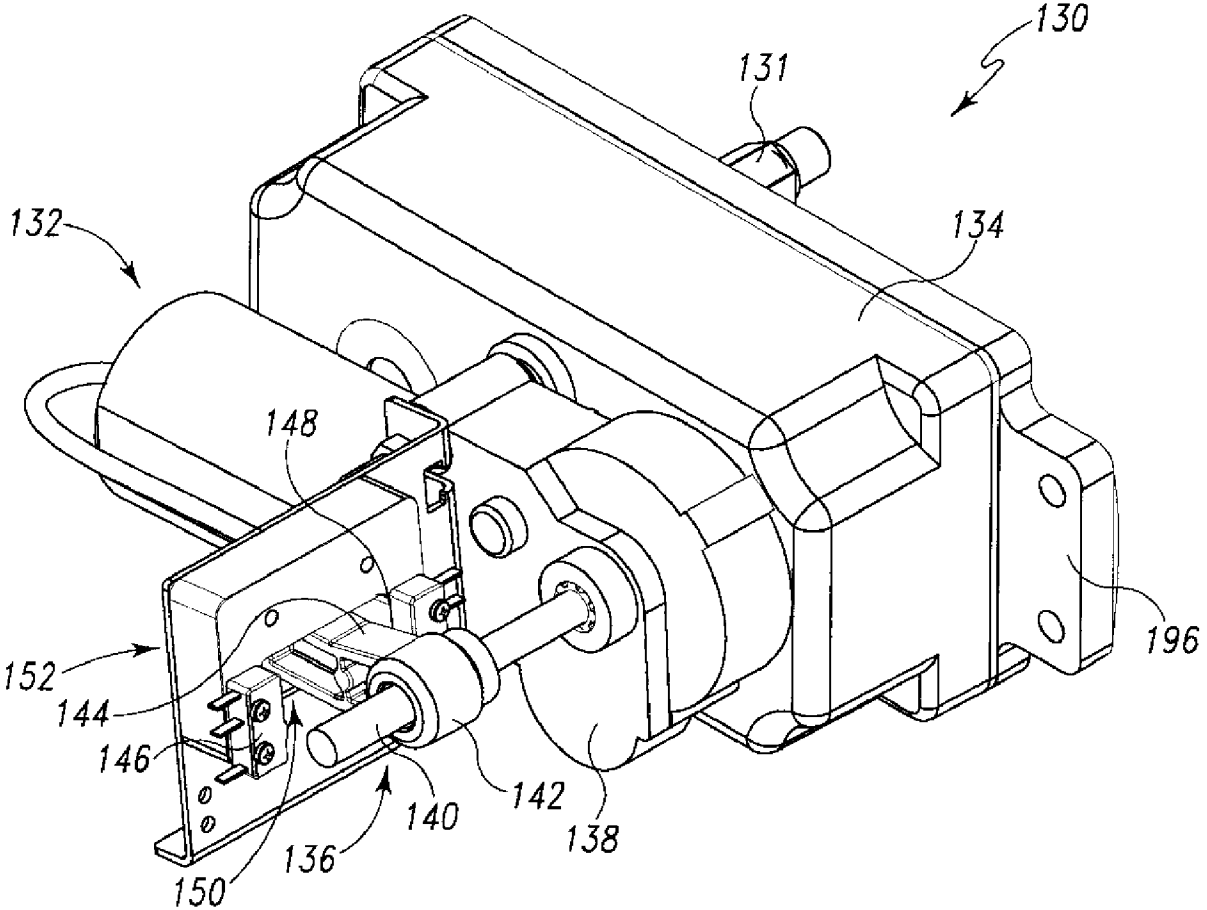
FIG. 10 is a perspective view of a prime mover shown in FIG. 8.

Tether 58 is formed to included an end 102 in which tether material is wrapped back upon itself. End 102 is received in a cavity 108 formed in cap member 96. A pin 104 is received in a cavity 106 inboard of cavity 108. Tether end 102 is secured in cavity 108 by a clamp member 110 which is secured to cap member 96 by a plurality of fasteners 112 and 114. Clamp member 110 includes an upper portion 120 and a lower potion 122 that are interposed between the layers of end 102 as shown in FIG. 7. Clamp member 110 secures end 102 of tether 58 into cavity 108 and is configured such that additional force in tether 58 increases the grip of clamp member 110. Pin 104 floats in cavity 106. The radius of the cylindrical surface of pin 104 transfers the generally vertical force acting on tether 58 without creating a stress riser in the tether 58 to reduce fatigue of tether 58. Illustratively, tethers 56 and 58 are embodied as hardened 301 stainless steel strips. A cover 116 is secured to cap member 96 via fasteners 118 and protects the securing assembly for intrusion of liquids.

Spool 62 is driven by a prime mover 130 embodied as a drive assembly as seen in FIG. 3. Prime mover 130 is secured to carriage 52 through a plurality of studs 194 onto which a plate 196 of prime mover 30 is fit and secured by a plurality of nuts 198. Drive assembly 130 comprises a motor 132 with an output coupled to a speed reducer 134 and a limit assembly 136. Motor 132 includes a transmission 138 which changes the direction of the output of motor 132 by 90 degrees. In the illustrative embodiment, the motor and transmission is a part number 0320AR available from Nidec Motors & Actuators of Ciudad Juarez, Chihuahua, Mexico. An output shaft 131 extends from speed reducer 134 to drive spool 62.

An acme screw 140 coupled to transmission 138 is rotated as motor 132 runs. Limit assembly 136 includes a nut 142 and a 144 wiper coupled to the nut 142. Nut 142 moves along screw 140 as motor 132 is driven to thereby move the wiper 144 between to limit sensors 146 and 148. Contact with either one of the limit sensors 146 or 148 cuts power to motor 132 and thereby limits the travel of carriage 52 as shown in the electrical schematic of FIG. 11. Wiper 144 moves along a channel 150 formed in a limit guide 152 coupled to motor 132.

In addition to the motors 132 of each of the lift systems 32 and 34, bed 10 includes additional drives, one to drive head section 38 and one to drive seat section 40. The head section drive is a part number LA27-U038-00 and seat section drives is a part number LA27-U039-00 both of which are available from Linak U.S., Inc. of Louisville, Ky. A discussion of the articulation of the bed 10 is included in a related patent application titled FRAME FOR A PATIENT-SUPPORT APPARATUS, and having an application Ser. No. 11/960,303 which is incorporated in its entirety by reference herein. Various configurations of a controller 154 are used to control the operation of the bed 10 based on the power available to the system. Various configurations of controller are available from Linak U.S., Inc. of Louisville, Ky. For example, a part number CB6036 controller from Linak is configured for mains power of 120 VAC at 60 Hz. A part number CB6035 from Linak is configured for mains power of 230 VAC at 50 Hz. A CB6037 from Linak is configured for 100 VAC at 50 Hz. Each of these units convert power from mains to operate the DC drive system of the bed. In addition, each of the systems includes a battery charger to charge a standby battery which may be used when the bed 10 is disconnected from mains. The controller 154 is mounted to the carriage of lift system 34 and includes a power cord 156 which receives power from a standard wall outlet.

Lift 32 further includes a plurality of lock-out switches 160, 162 and 164 which each lock out the head function, knee function, and hilow functions of the bed 10 respectively. The lock-out switches 160, 162 and 164 are each toggle switches and are actuable between two positions. As shown in the schematic in FIG. 11, the lock-out switches 160, 162 and 164 operable to interrupt the connection between the pendant 27 the controller 156 to prevent operation of the various functions of bed 10. Two batteries 166, 166 are supported on the carriage 54 of lift system 32 and provide power to controller 156. The batteries are a part number BPI1.2-12 available from B.B. Battery Co., LTD through B & B Battery USA, Inc. of Commerce, Calif.

Lift system 32 further includes two receptacles 168, 168 secured to carriage 52 by a plurality of fasteners 170. Receptacles 168, 168 are configure to receive a portion of head end panel 20 to support the head end panel 20 on the carriage 52. An outer cover 172 secured to carriage 52 with a plurality of fasteners 174 cooperates with an inner cover 176 to enclose a portion of carriage 52. Cover 176 is secured to carriage with a plurality of fasteners 174. A cover 178 is secured to carriage 52 to enclose the prime mover 130 and batteries 166, 166. An interface plate 180 couples to carriage 52 via a plurality of fasteners 182 and provides an interface point for connectors from cables coupled to the batteries and the lockout switches to communicate external to the lift system 32. An aperture 184 serves to support a connector from prime mover 130 to permit communication of electrical power and signals external to the lift system 32.

The lower ends of supports 48 and 50 engage with retainers 186 and 188 respectively such that tubes 90 and 92 are supported in relation to supports 48 and 50 respectively. Two casters 190 and 192 are each received in the bottom of supports 48 and 50 respectively to support lift system 32 and thereby bed 10 for movement across a floor. Frame 44 of platform 28 is secured to lift systems 32 and 34 by a plurality of bolts 200 and a plurality of nuts 202. The effective length of bed 10 can be changed by altering the position of bolts 200 and nuts 202 relative to frame 72 of lifts 32 and 34.

Having a "knock-down" type construction, bed 10 is suitable for use in a home as the various portions of bed 10 can be disassembled and assembled with the use of standard tools. Thus, frame 33, lift systems 32 and 34 and deck sections 38, 40 and 42 can be shipped separately and assembled on site. In general, articulating beds employing compound movement of deck sections relative to a frame are bulky and difficult to use in a non-institutional environment.

Although certain illustrative embodiments have been described in detail above, variations and modifications exist within the scope and spirit of this disclosure as described and as defined in the following claims.

The invention claimed is:

1. A patient-support apparatus comprising a plurality of supports, a first tether coupled to a first support, a second tether coupled to a second support, a patient-support platform, the patient-support platform includes a frame, a plurality of deck sections pivotable relative to the frame, a plurality of actuators each coupled to a deck section, the actuators configured to control a pivoting of the deck sections relative to the frame, and winding means for winding and unwinding the tethers to vary the height of the patient-support platform relative to the supports such that as the tethers are wound the second tether is wound upon the first tether.

2. The patient-support apparatus of claim 1, wherein the winding means is secured to the patient-support platform.

3. The patient-support apparatus of claim 2, wherein the winding means comprises a prime mover and a spool driven by the prime mover.

4. The patient-support apparatus of claim 3, wherein the prime mover comprises a motor including an output to drive the spool, the output driving a limit assembly configured to limit the operation of the motor when the patient-support platform reaches a vertical limit.

5. The patient-support apparatus of claim 4, wherein the prime mover further comprises a speed reducer interposed between the motor and the spool.

6. The patient-support apparatus of claim 1, wherein the winding means comprises a prime mover and a spool driven by the prime mover.

7. The patient-support apparatus of claim 6, wherein the prime mover comprises a motor including an output to drive the spool, the output driving a limit assembly configured to limit the operation of the motor when the patient-support platform reaches a vertical limit.

8. The patient-support apparatus of claim 7, wherein the tether comprises a stainless steel strap.

9. The patient-support apparatus of claim 1, wherein the tether comprises a stainless steel strap.

10. A lift system for a patient-support apparatus comprising first and second tethers configured to be coupled to a first portion of the patient-support apparatus, and a winder coupled to the tethers distal to the first portion, the winder configured to be coupled to a second portion of the patient-support apparatus and to rotate relative to the second portion of the patient-support apparatus to wind the first tether upon the second tether to vertically raise the second portion relative to the first portion and to unwind the first tether and the second tether to vertically lower the second portion relative to the first portion.

11. The lift system of claim 10, wherein the winder comprises a spool, a motor including an output to drive the spool, the output driving a limit assembly configured to limit the operation of the motor when the patient-support platform reaches a vertical limit.

12. The lift system of claim 11, wherein the winder further comprises a speed reducer interposed between the motor and the spool.

13. The lift system of claim 12, wherein the tethers are each a stainless steel strap.

14. A patient-support apparatus comprising a patient-support platform, the patient-support platform includes a frame and a plurality of deck sections pivotable relative to the frame, a plurality of columns configured to engage a floor, a tether coupled to each column, and a winder coupled to the patient-support platform and suspended by the tethers, the winder configured to gather the tethers such that the tethers overlie one another and release the tethers to thereby raise and lower the patient-support platform relative to the floor.

15. The patient-support apparatus of claim 14, wherein the winder is driven by a motor.

16. The patient-support apparatus of claim 14, wherein the winder comprises a spool, a motor including an output to drive the spool, the output driving a limit assembly configured to limit the operation of the motor when the patient-support platform reaches a vertical limit.

17. The patient-support apparatus of claim 16, wherein the tether comprises a first tether portion coupled to a first column and a second tether portion coupled to a second column and wherein each of the tether portions are contemporaneously gathered and released by the winder such that the patient-support platform raises and lowers along each of the first and second columns at generally the same speed.

18. The patient-support apparatus of claim 17, wherein the patient-support platform includes an outer tube coupled to the frame and configured to receive a column and a spool coupled to the outer tube, the spool configured to engage the tether and to rotate relative to the outer tube as the tether is gathered and released by the winder such that the spool guides the tether to the winder as the winder rotates.

19. A patient-support apparatus comprising a first portion, a first and second tethers coupled to a first portion of the patient-support apparatus, a second portion of the patient-support apparatus movable relative to the first portion, and a winder coupled to the each of the first and second tethers distal to the first portion, the winder supported on the second portion and rotatable relative to the second portion to wind the tethers such that the tethers overlie one another and unwind the first and second tethers to thereby move the second portion of the patient-support apparatus vertically relative to the first portion.

20. The patient-support apparatus of claim 19, wherein the winder is driven by a motor.

21. The patient-support apparatus of claim 20, wherein the tether engages a roller on the second portion, the roller configured to guide the tether as the winder gathers and releases the tether.

22. The patient-support apparatus of claim 21, wherein the tether comprises a stainless steel strap.

23. The patient-support apparatus of claim 22, wherein the winder comprises a spool and a motor driving the spool to rotate the spool about a horizontal axis, and a speed reducer interposed between the motor and the spool.

* * * * *